US008824927B2

(12) United States Patent
Watanabe et al.

(10) Patent No.: US 8,824,927 B2
(45) Date of Patent: Sep. 2, 2014

(54) FIXING DEVICE AND IMAGE FORMING APPARATUS INCLUDING A RELEASE MEMBER

(75) Inventors: Shigeru Watanabe, Kanagawa (JP); Masami Ishida, Kanagawa (JP); Kiichirou Arikawa, Kanagawa (JP); Yoshiro Konishi, Kanagawa (JP); Hiroko Furukata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 155 days.

(21) Appl. No.: 13/408,669

(22) Filed: Feb. 29, 2012

(65) Prior Publication Data

US 2013/0064585 A1 Mar. 14, 2013

(30) Foreign Application Priority Data

Sep. 14, 2011 (JP) ..... 2011-200647

(51) Int. Cl.
*G03G 15/16* (2006.01)

(52) U.S. Cl.
USPC ..... 399/122

(58) Field of Classification Search
USPC ..... 399/122, 320, 328, 329; 219/216
See application file for complete search history.

(56) References Cited

U.S. PATENT DOCUMENTS

| | | | | |
|---|---|---|---|---|
| 7,647,016 | B2 * | 1/2010 | Saiki | 399/329 |
| 8,010,017 | B2 * | 8/2011 | Foster et al. | 399/122 |
| 8,073,375 | B2 * | 12/2011 | Hiraoka et al. | 399/329 |
| 8,385,800 | B2 * | 2/2013 | Masuda et al. | 399/328 |

FOREIGN PATENT DOCUMENTS

| | | | |
|---|---|---|---|
| JP | 01203127 A | * | 8/1989 |
| JP | 2002040862 A | * | 2/2002 |
| JP | 2006-58709 A | | 3/2006 |
| JP | 2008164780 A | * | 7/2008 |

* cited by examiner

*Primary Examiner* — Robert Beatty
(74) *Attorney, Agent, or Firm* — Sughrue Mion, PLLC

(57) ABSTRACT

A fixing device includes a heating rotating body that heats a developer image formed on a recording medium, a pressurizing rotating body that pressurizes the recording medium by nipping the recording medium between the pressurizing rotating body and the heating rotating body, a pair of support plates that rotatably support both ends of one of the pressurizing rotating body and the heating rotating body, and a release member including an attachment portion attached to the support plates to hold the support plates from both sides in a thickness direction, and an operating portion. When an external force in a predetermined direction acts on the operating portion, the release member releases pressing of the one of the pressurizing rotating body and the heating rotating body against the other by moving the support plates in a direction away from the other.

7 Claims, 9 Drawing Sheets

FIXING DEVICE AND IMAGE FORMING APPARATUS INCLUDING A RELEASE MEMBER

CROSS-REFERENCE TO RELATED APPLICATIONS

This application is based on and claims priority under 35 USC 119 from Japanese Patent Application No. 2011-200647 filed Sep. 14, 2011.

BACKGROUND

Technical Field

The present invention relates to a fixing device and an image forming apparatus.

SUMMARY

According to an aspect of the invention, there is provided a fixing device including: a heating rotating body that heats a developer image formed on a recording medium; a pressurizing rotating body that pressurizes the recording medium by nipping the recording medium between the pressurizing rotating body and the heating rotating body; a pair of support plates that rotatably support both ends of one of the pressurizing rotating body and the heating rotating body, the support plates having a thickness direction corresponding to an axial direction of the pressurizing rotating body; and a release member including an attachment portion attached to the support plates to hold the support plates from both sides in the thickness direction, and an operating portion on which an external force acts. When an external force in a predetermined direction acts on the operating portion, the release member releases pressing of the one of the pressurizing rotating body and the heating rotating body against the other of the pressurizing rotating body and the heating rotating body by moving the support plates in a direction away from the other of the pressurizing rotating body and the heating rotating body.

BRIEF DESCRIPTION OF THE DRAWINGS

Exemplary embodiment(s) of the present invention will be described in detail based on the following figures, wherein.

DETAILED DESCRIPTION

An image forming apparatus according to an exemplary embodiment of the invention will be described.

Overall Configuration

Figure 1:
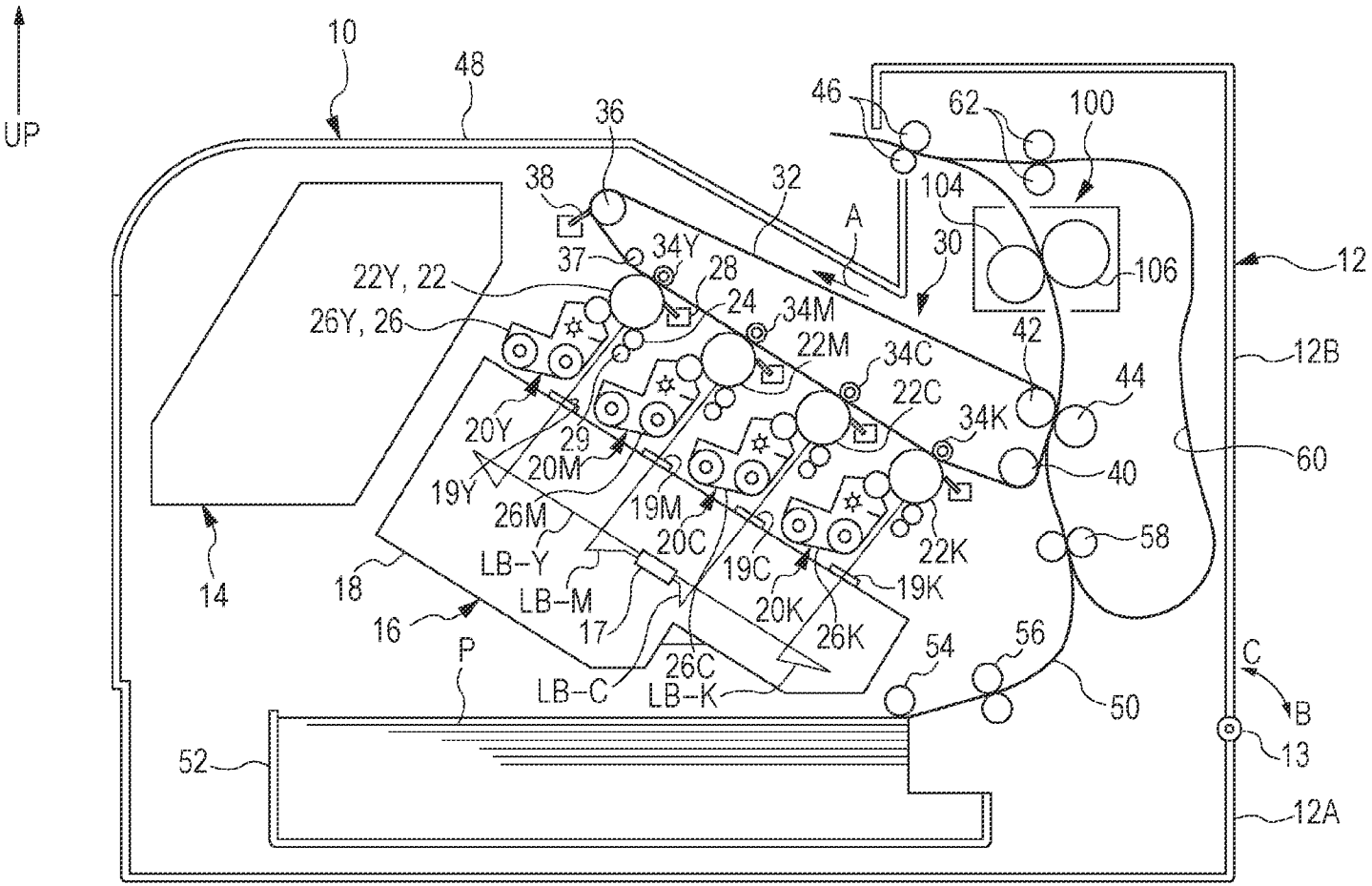
FIG. 1 illustrates an overall configuration of an image forming apparatus according to an exemplary embodiment of the present invention.

FIG. 1 illustrates an image forming apparatus 10 according to the exemplary embodiment. The image forming apparatus 10 has a housing 12 including a body section 12A and a cover section 12B. The body section 12A stores units and members from a sheet storage portion 52 to output rollers 46 that will be described below. The cover section 12B is connected to the body section 12A by a hinge member 13. By moving the cover section 12B in an arc form in a direction of arrow B (clockwise direction in the figure), a below-described fixing device 100 is exposed. In contrast, by moving the cover section 12B in an arc form in a direction of arrow C (counterclockwise direction in the figure), the body section 12A and the cover section 12B of the housing 12 are combined to form a box. In the housing 12, an image processing unit 14 is provided to conduct image processing on input image data.

The image processing unit 14 processes input image data into gradation data of four colors of yellow (Y), magenta (M), cyan (C), and black (K). According to the gradation data processed by the image processing unit 14, an exposure device 16 provided in the center of the housing 12 performs exposure with laser light beams LB.

The exposure device 16 includes four semiconductor lasers (not illustrated) having a common structure and corresponding to four image forming units 20Y, 20M, 20C, and 20K (described in detail below). The semiconductor lasers emit laser light beams LB-Y, LB-M, LB-C, and LB-K according to the gradation data.

The laser light beams LB-Y, LB-M, LB-C, and LB-K emitted from the semiconductor lasers are applied onto a polygonal mirror 17 serving as a rotating polygonal mirror through a cylindrical lens (not illustrated), and are deflectively scanned by the polygonal mirror 17. The laser light beams LB-Y, LB-M, LB-C, and LB-K defectively scanned by the polygonal mirror 17 are each scanned from an obliquely lower side to expose an exposure point on a corresponding photoconductor 22 (described in detail below) through an imaging lens and plural mirrors (not illustrated).

The exposure device 16 is enclosed by a frame 18 shaped like a rectangular parallelepiped. On an upper side of the frame 18, transparent glass windows 19Y, 19M, 19C, and 19K are provided to transmit the four laser light beams LB-Y, LB-M, LB-C, and LB-K onto photoconductors 22 (22Y, 22M, 22C, and 22K) in the image forming units 20Y, 20M, 20C, and 20K, respectively.

Above the exposure device 16, four image forming units 20Y, 20M, 20C, and 20K corresponding to yellow (Y), magenta (M), cyan (C), and black (K) are provided as an example of a developer-image forming unit. The image forming units 20Y, 20M, 20C, and 20K are arranged at intervals in a direction inclined with respect to the horizontal direction. When there is no need to distinguish among the colors Y, M, C, and K, the indexes Y, M, C, and K written after the reference numerals are sometimes omitted.

The image forming units 20Y, 20M, 20C, and 20K are similar in structure except in toner (developer) to be used. Each of the image forming units 20Y, 20M, 20C, and 20K includes a columnar photoconductor 22, a charging roller 24, a developing device 26 (26Y, 26M, 26C, 26K), and a cleaning blade 28. The photoconductor 22 is rotated at a predetermined speed. The charging roller 24 charges an outer peripheral surface of the photoconductor 22. The developing device 26 develops an electrostatic latent image, which is formed on the charged outer peripheral surface of the photoconductor 22 by exposure with the exposure device 16, with toner of a predetermined color into a visible toner image (developer image). The cleaning blade 28 cleans the outer peripheral surface of the photoconductor 22 after the toner image is transferred. On a lower side of the charging roller 24, a cleaning roller 29 is provided to clean an outer peripheral surface of the charging roller 24 by contact therewith.

A first transfer unit 30 serving as an example of a transfer unit is provided above the image forming units 20Y, 20M, 20C, and 20K.

The first transfer unit 30 includes an endless intermediate transfer belt 32, a driving roller 36, a tensioning roller 40, a driven roller 42, first transfer rollers 34Y, 34M, 34C, and 34K, and a support roller 37. The intermediate transfer belt 32 is wound on the driving roller 36, and the driving roller 36 rotates to circle the intermediate transfer belt 32 in a direction of arrow. The intermediate transfer belt 32 is also wound on the tensioning roller 40. The tensioning roller 40 applies tension to the intermediate transfer belt 32. The driven roller 42 is provided above the tensioning roller 40, and is rotated along with the rotation of the intermediate transfer belt 32. The first transfer rollers 34Y, 34M, 34C, and 34K are provided on a side of the intermediate transfer belt 32 opposite the photoconductors 22Y, 22M, 22C, and 22K. The support roller 37 is provided between the driving roller 36 and the first transfer roller 34Y to support a back surface of the intermediate transfer belt 32.

The four first transfer rollers 34Y, 34M, 34C, and 34K multiply transfer toner images of yellow (Y), magenta (M), cyan (C), and black (K), which are sequentially formed on the photoconductors 22 in the image forming units 20Y, 20M, 20C, and 20K, onto the intermediate transfer belt 32. Further, a cleaning blade 38 for cleaning an outer peripheral surface of the intermediate transfer belt 32 is provided on a side of the intermediate transfer belt 32 opposite the driving roller 36.

A second transfer roller 44 serving as an example of a transfer unit is provided on a side of the intermediate transfer belt 32 opposite the driven roller 42. A voltage application unit (not illustrated) is connected to the second transfer roller 44 and the driven roller 42 so as to form a potential difference between the potential of the second transfer roller 44 and the potential of the driven roller 42. The toner images of yellow (Y), magenta (M), cyan (C), and black (K) multiply transferred on the intermediate transfer belt 32 are transported by the intermediate transfer belt 32, and are secondarily transferred onto a recording sheet (recording medium) P by the action of an electric field formed by the potential difference between the driven roller 42 and the second transfer roller 44. In the housing 12, a sheet transport path 50 is also provided. On the sheet transport path 50, a second transfer position is set as a contact portion between the intermediate transfer belt 32 and the second transfer roller 44.

A fixing device 100 is provided on a downstream side of the second transfer roller 44 in a transport direction of the recording sheet P (hereinafter simply referred to as a downstream side). The fixing device 100 fixes the transferred toner images on the recording sheet P with heat and pressure. The fixing device 100 will be described in detail below. On a downstream side of the fixing device 100, output rollers 46 are provided to output the recording sheet P, on which the toner images are fixed, into an output portion 48 provided at the top of the housing 12 of the image forming apparatus 10.

A sheet storage portion 52 is provided in a lower part of the housing 12, and recording sheets P are stacked in the sheet storage portion 52. Above the sheet storage portion 52, a paper feed roller 54 is provided to feed the recording sheets P stacked in the sheet storage portion 52 into the sheet transport path 50. On a downstream side of the paper feed roller 54, separation rollers 56 are provided to separate and transport the recording sheets P one by one. On a downstream side of the separation rollers 56, registration rollers 58 are provided to determine the timing of transport of a recording sheet P to the second transfer position. With this structure, a recording sheet P transported from the sheet storage portion 52 is supplied to the second transfer position by the registration rollers 58 that rotate at a predetermined timing.

A duplex transport path 60 is connected between a position between the separation rollers 56 and the registration rollers 58 and a position between the fixing device 100 and the output rollers 46 in the sheet transport path 50 so that image formation and fixing are conducted on both surfaces of a recording sheet P. Transport rollers 62 are provided next to the output rollers 46 on the duplex transport path 60. The transport rollers 62 transport a recording sheet P, on which a toner image is fixed on a front surface by the fixing device 100, to the duplex transport path 60 without simply outputting the recording sheet P into the output portion 48 via the output rollers 46. Thus, the recording sheet P transported along the duplex transport path 60 is transported to the registration rollers 58 again while being turned upside down, and is output into the output portion 48 after a toner image is transferred and fixed on a back surface thereof.

Next, an image forming procedure performed in the image forming apparatus 10 will be described.

First, color gradation data are sequentially output from the image processing unit 14 to the exposure device 16, and the exposure device 16 emits laser light beams LB-Y, LB-M, LB-C, and LB-K according to the gradation data. The laser light beams LB-Y, LB-M, LB-C, and LB-K are scanned to expose the outer peripheral surfaces of the photoconductors 22 charged by the charging rollers 24, so that electrostatic latent images are formed on the outer peripheral surfaces of the photoconductors 22.

The electrostatic latent images formed on the photoconductors 22 are developed into visible toner images of yellow (Y), magenta (M), cyan (C), and black (K) by the developing devices 26Y, 26M, 26C, and 26K, respectively. These toner images are multiply transferred onto the circling intermediate transfer belt 32 by the first transfer rollers 34.

Next, the color toner images multiply transferred on the circling intermediate transfer belt 32 are secondarily transferred by the second transfer roller 44 onto a recording sheet P that is transported to the second transfer position in the sheet transport path 50 at a predetermined timing by the registration rollers 58.

The recording sheet P on which the toner images are transferred is then transported to the fixing device 100, where the transferred toner images are fixed on the recording sheet P. When an image is to be formed on only one surface, the recording sheet P is output by the output rollers 46 into the output portion 48 after the toner images are fixed.

In contrast, when images are to be formed on both surfaces of the recording sheet P, after toner images are fixed on the front surface of the recording sheet P by the fixing device 100, the recording sheet P is not simply output to the output portion 48 by the output rollers 46, but is led into the duplex transport path 60 via the transport rollers 62 by switching the transport direction. When the recording sheet P is transported along the duplex transport path 60, it is turned upside down, and is transported to the registration rollers 58 again. Then, toner images are transferred and fixed onto a back surface of the recording sheet P similarly to the front surface, and the recording sheet P having the images on both surfaces is output into the output portion 48 by the output rollers 46.

Structure of Principal Part

Next, the fixing device 100 will be described.

Figure 2:
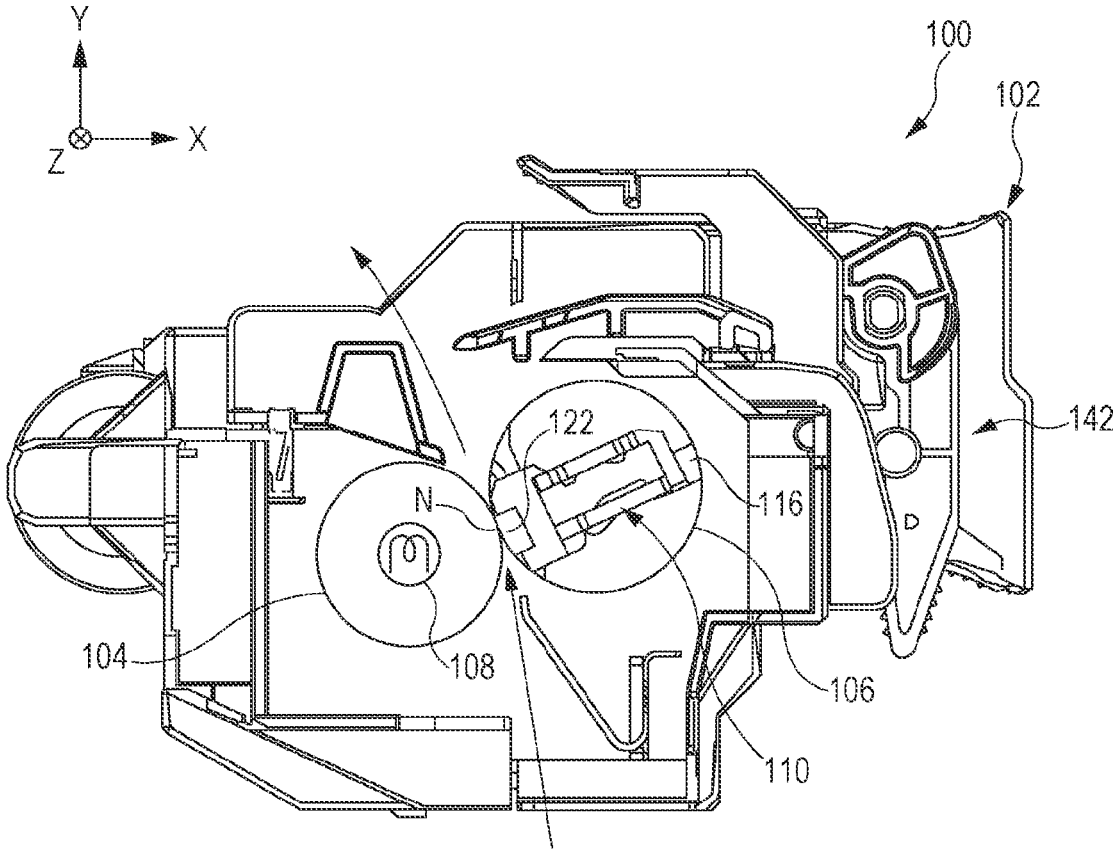
FIG. 2 illustrates an internal structure of a fixing device according to the exemplary embodiment.

As illustrated in FIG. 2, the fixing device 100 has a housing 102 shaped like a rectangular parallelepiped. The fixing device 100 further includes a heating roller 104 serving as an example of a heating rotating body, a pressurizing belt 106 serving as an example of a pressurizing rotating body, and lever members 140 (see FIG. 4A) serving as an example of a support plate that rotatably supports both ends of the pressurizing belt 106, and operation levers 142 (see FIG. 4A) serving as an example of a release member that releases pressing of the pressurizing belt 106 against the heating roller 104.

As an example, the heating roller 104 is a cylindrical member whose axial direction is a direction of arrow Z serving as a width direction of a recording sheet P (see FIG. 1) and a main scanning direction of the exposure device 16 (see FIG. 1) and which is open at both ends in the direction of arrow Z. The heating roller 104 has a multilayered structure in which an elastic layer of silicone rubber and a release layer containing fluorine resin are stacked on an outer peripheral surface of a thin and cylindrical base material of steel. In the heating roller 104, a halogen lamp 108 serving as an example of a heat source is provided at a distance from an inner peripheral surface of the heating roller 104. The axial direction of the halogen lamp 108 is the direction of arrow Z. A horizontal direction orthogonal to the direction of arrow Z is designated as a direction of arrow X and a vertical direction orthogonal to the direction of arrow X and the direction of arrow Z is designated as a direction of arrow Y. In the following description, these directions are simply referred to as an X-direction, a Y-direction, and a Z-direction.

As an example, the pressurizing belt 106 is an endless belt member whose axial direction is the Z-direction, and which is open at both ends in the Z-direction. Also, the pressurizing belt 106 has a multilayered structure in which an elastic layer of silicone rubber and a release layer containing fluorine resin are stacked on an outer peripheral surface of a thin and cylindrical base material of polyimide. On an inner side of the pressurizing belt 106, a support unit 110 for rotatably supporting the pressurizing belt 106 in cooperation with the lever members 140 (see FIG. 4A), and a nip member 112 and a pad member 122 provided in the support unit 110 to press an outer peripheral surface of the pressurizing belt 106 against an outer peripheral surface of the heating roller 104 are provided. The pressurizing belt 106 pressurizes a recording sheet P (not illustrated) by nipping the recording sheet P in cooperation with the heating roller 104. A portion where the outer peripheral surface of the heating roller 104 and the outer peripheral surface of the pressurizing belt 106 are in contact with each other (nip the recording sheet P) serves as a nip portion N.

Figure 3:
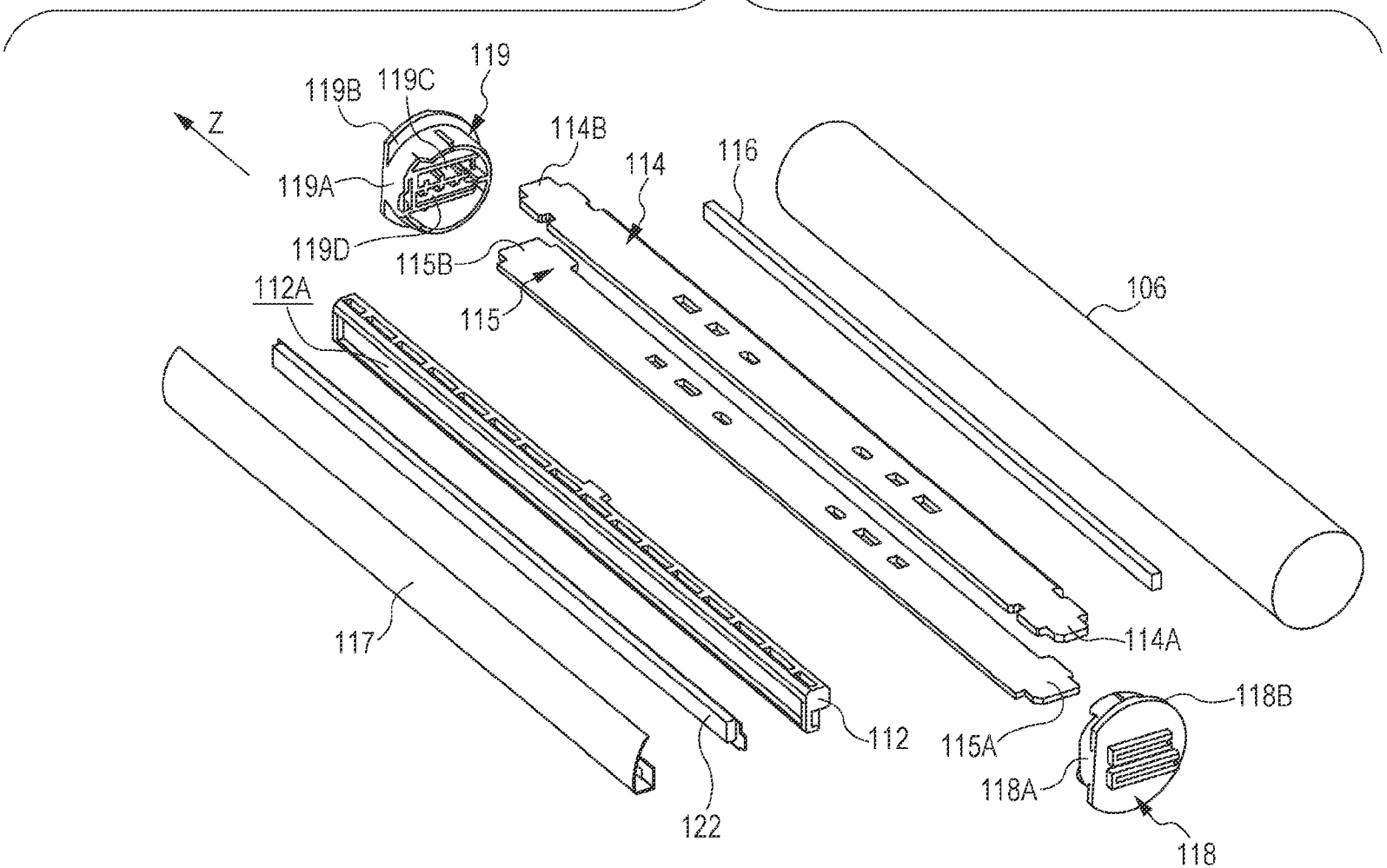
FIG. 3 is an exploded view of a pressurizing belt and a support unit in the exemplary embodiment.

As illustrated in FIG. 3, the support unit 110 includes the nip member 112 formed of synthetic resin, belt frames 114 and 115 formed by two metal plates fixed in an upright position to an upper surface of the nip member 112, a felt member 116 attached to upper ends of the belt frames 114 and 115, a slide sheet 117 attached to the nip member 112 to allow sliding of the pressurizing belt 106, a belt guide member 118 attached to ends 114A and 115A of the belt frames 114 and 115 in the Z-direction, and a belt guide member 119 attached to opposite ends 114B and 115B of the belt frames 114 and 115 in the Z-direction.

The nip member 112 has a recess 112A opening on a nip portion N side (see FIG. 2). In the recess 112A, the pad member 122 is fixed. The felt member 116 is impregnated with lubricant oil, and supplies the oil to an inner peripheral surface of the pressurizing belt 106 by contact therewith.

The belt guide member 118 includes a cylindrical peripheral wall 118A opening in the Z-direction, and a flange portion 118B projecting in a radial direction of the peripheral wall 118A from one end of the peripheral wall 118A in a direction opposite the Z-direction. On an inner side of the peripheral wall 118A, fixing portions (not illustrate) are provided such that the ends 114A and 115A of the belt frames 114 and 115 are inserted and fixed therein.

Similarly, the belt guide member 119 includes a cylindrical peripheral wall 119A opening in the direction opposite the Z-direction, and a flange portion 119B projecting in a radial direction of the peripheral wall 119A at one end of the peripheral wall 119A in the Z-direction. On an inner side of the peripheral wall 119A, fixing portions 119C and 119D are provided such that the opposite ends 114B and 115B of the belt frames 114 and 115 are inserted and fitted therein. Portions of the flange portions 118B and 119B located on a nip portion N side (see FIG. 2) are cut out so as not to touch the pressurizing belt 106 when the pressurizing belt 106 deforms at the nip portion N.

Figure 4A:
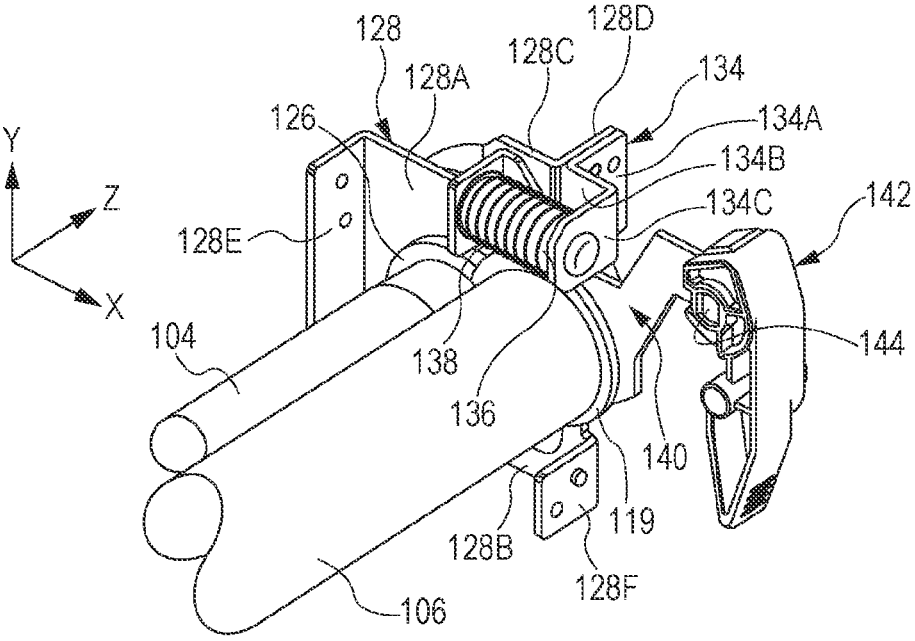
FIGS. 4A and 4B are a perspective view and a side view, respectively, illustrating a support structure for ends of a heating roller and the pressurizing belt in the exemplary embodiment.
Figure 4B:
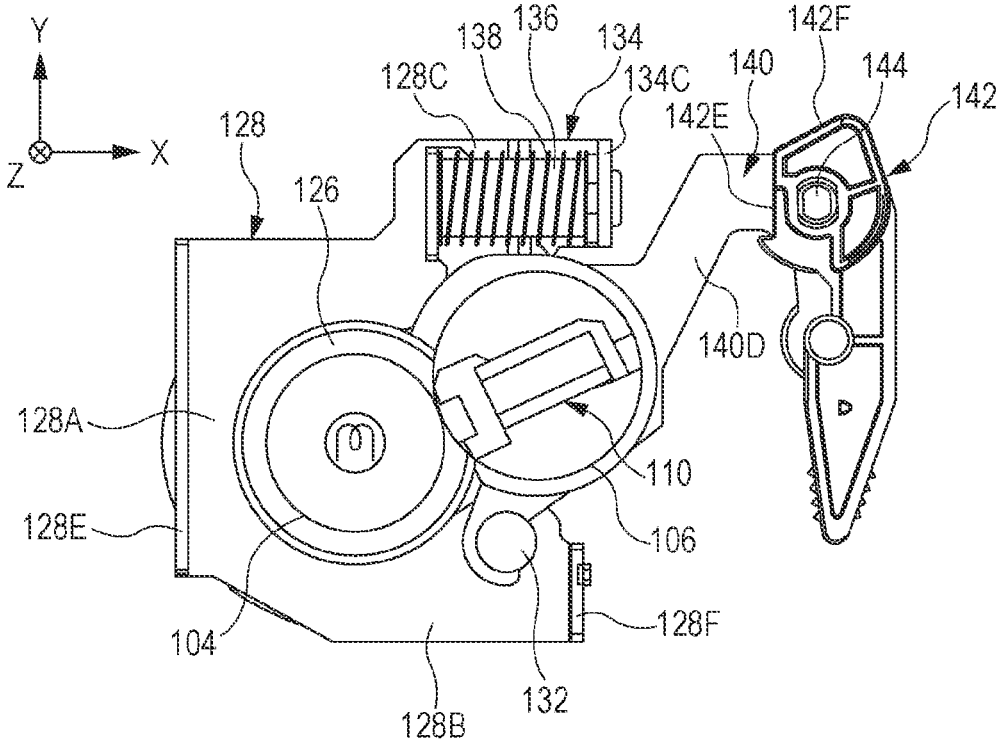

As illustrated in FIGS. 4A and 4B, each end of the heating roller 104 is inserted in a bearing 126. The bearing 126 is fitted and fixed in a bracket 128 that is substantially angular U-shaped, as viewed in the Z-direction. Thus, the heating roller 104 is rotatably supported by the bracket 128.

The bracket 128 includes an angular U-shaped attachment portion 128A to which the bearing 126 is attached, a pivot portion 128B provided at one end of the attachment portion 128A (a lower open end) to support a below-described lever member 140 movably in an arc form, and a biasing portion 128C provided at the other end of the attachment portion 128A (an upper end opposite the pivot portion 128B). The bracket 128 stands upright in the Y-direction, as viewed in the X-direction.

The pivot portion 128B has a through-hole (not illustrated) that penetrates the pivot portion 128B in the Z-direction (width direction). By inserting a columnar pin member 132 in this through-hole and a through-hole (not illustrated) provided in a lower end of the lever member 140, the lever member 140 is allowed to move in an arc form relative to the bracket 128.

An end of the biasing portion 128C has an attachment face 128D bent in the Z-direction and extending along a Y-Z plane. To the attachment face 128D, a support bracket 134 is fixed by screws (not illustrated). The support bracket 134 is formed by bending one metal plate at a right angle at two positions. The support bracket 134 includes an attached portion 134A to be attached to the attachment face 128D, a center portion 134B bent at a right angle in the X-direction relative to the attached portion 134A, and a support portion 134C bent at a right angle relative to the center portion 134B in a direction opposite the Z-direction.

The support portion 134C extends along the Y-Z plane, and one axial end of a columnar rod 136 extending in a direction opposite the X-direction is fixed thereto. The rod 136 is inserted in a spring 138 that biases the lever member 140 toward a heating roller 104 side (in a direction opposite the X-direction). The other end of the rod 136 is not fixed, but serves as a free end.

The attachment portion 128A has a bent portion 128E bent at a right angle in the direction opposite the Z-direction, and the pivot portion 128B has a bent portion 128F bent in the direction opposite the Z-direction. The bent portions 128E and 128F are fixed to the housing 102 (see FIG. 2) by screws (not illustrated) so that the bracket 128 is fixed upright in the housing 102.

Figure 5A:
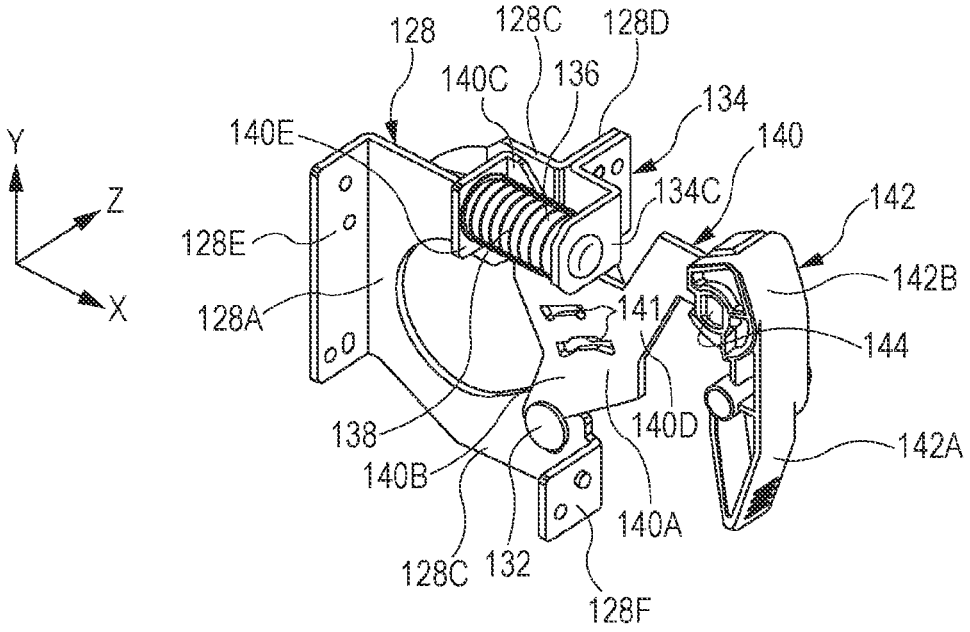
FIG. 5A is a perspective view illustrating the support structure for the ends of the heating roller and the pressurizing belt in the exemplary embodiment, and FIG. 5B schematically illustrates a coupling state between an operation lever and a lever member in the exemplary embodiment.

As illustrated in FIG. 5A, the lever member 140 includes a platelike center portion 140A (located along the X-Y plane), a pivot attachment portion 140B, a biased portion 140C, and an arm portion 140D. The center portion 140A has two fitting holes 141 in which projections (not illustrated) of the belt guide member 119 are to be fitted. The pivot attachment portion 140B projects from a lower end of the center portion 140A, and is turnably attached to the pivot portion 128B by the pin member 132. The biased portion 140C extends at the top of the center portion 140A and to a position adjacent to the biasing portion 128C (heating roller 104 side). The arm portion 140D extends at the top of the center portion 140A and toward a side opposite the biased portion 140C in the X-direction. Each end of the pressurizing belt 106 (see FIG. 2) is rotatably supported by the lever member 140.

At an end of the biased portion 140C in the direction opposite the X-direction, a biased face 140E bent in the direction opposite the Z-direction extends along the Y-Z plane. The biased face 140E faces the support portion 134C of the bracket 128 in the X-direction. The other end of the spring 138 is in contact with the biased face 140E to bias an upper part of the lever member 140 in the direction opposite the X-direction. Further, an operation lever 142 is turnably connected to an end of the arm portion 140D in the X-direction. When external force acts, the operation lever 142 moves the lever member 140 in a direction away from the heating roller 104 (see FIG. 2) so as to release pressing of the pressurizing belt 106 (see FIG. 2) against the heating roller 104.

The operation lever 142 includes an attachment portion 142B to be turnably attached to the arm portion 140D of the lever member 140, and an operating portion 142A to be operated while being held between the operator's fingers. As illustrated in FIG. 4B, a side face 142E is provided in an upper part of the operation lever 142 in the Y-direction. The side face 142E opposes a below-described side wall 102A of the housing 102 (see FIG. 6A), as viewed in the Z-direction, in a state in which the operation lever 142 is hanging in the Y-direction. An inclined face 142F continues from an upper end of the side face 142E. The inclined face 142F is inclined in a direction away from the lever member 140 (obliquely upward).

Figure 7A:
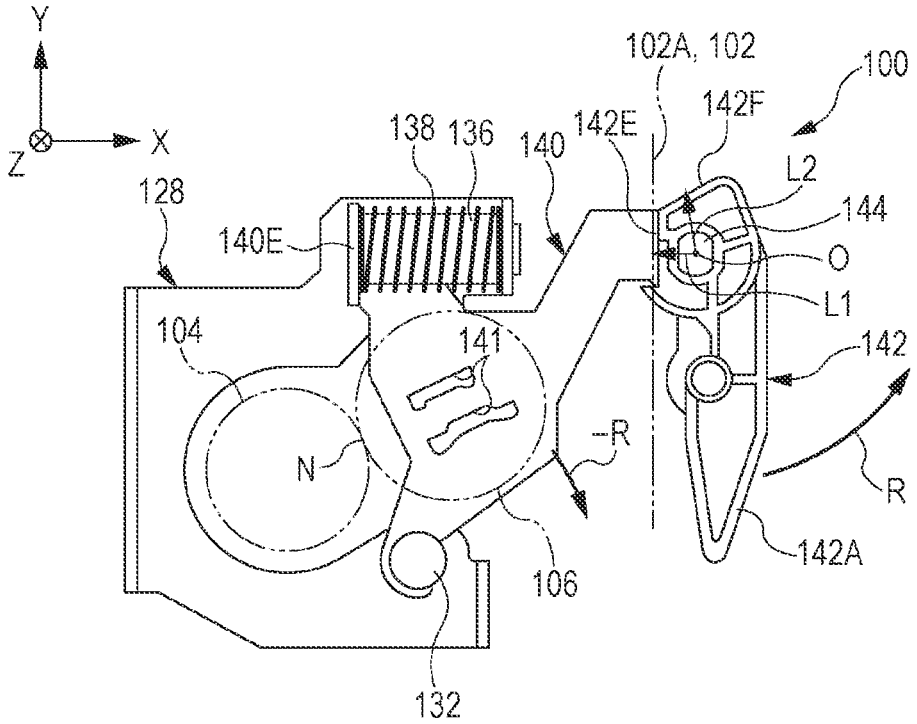
FIGS. 7A and 7B illustrate a state in which a nip state between the heating roller and the pressurizing belt is released when the operation lever is turned.

As illustrated in FIG. 7A, the operation lever 142 is formed such that a distance L2 from a rotation center O of a columnar shaft 144 to the inclined face 142F is longer than a distance L1 from the rotation center O to the side face 142E. Thus, when the operation lever 142 is turned in a direction of arrow R from a state hanging in the Y-direction, the inclined face 142F comes into contact with the side wall 102A of the housing 102.

Figure 5B:
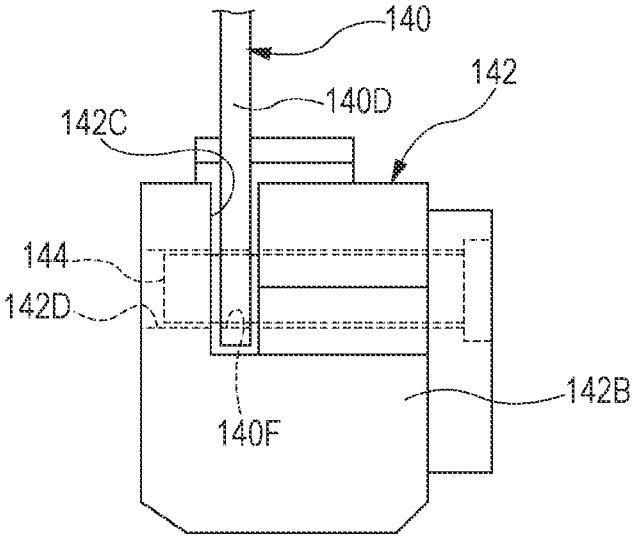

Further, as illustrated in FIG. 5B, the attachment portion 142B of the operation lever 142 has a recess 142C in which the arm portion 140D of the lever member 140 is to be inserted. The attachment portion 142B also has an attachment hole 142D that penetrates the attachment portion 142B in the Z-direction. By inserting the columnar shaft 144 in a through-hole 140F, which penetrates the arm portion 140D of the lever member 140 in the Z-direction, and the attachment hole 142D in a state in which the through-hole 140F and the attachment hole 142D are located coaxially (in the Z-direction), the operation lever 142 is turnably attached to the lever member 140. In this way, the attachment portion 142B is attached to the lever member 140 while holding the lever member 140 from both sides in the Z-direction (thickness direction).

Figure 6A:
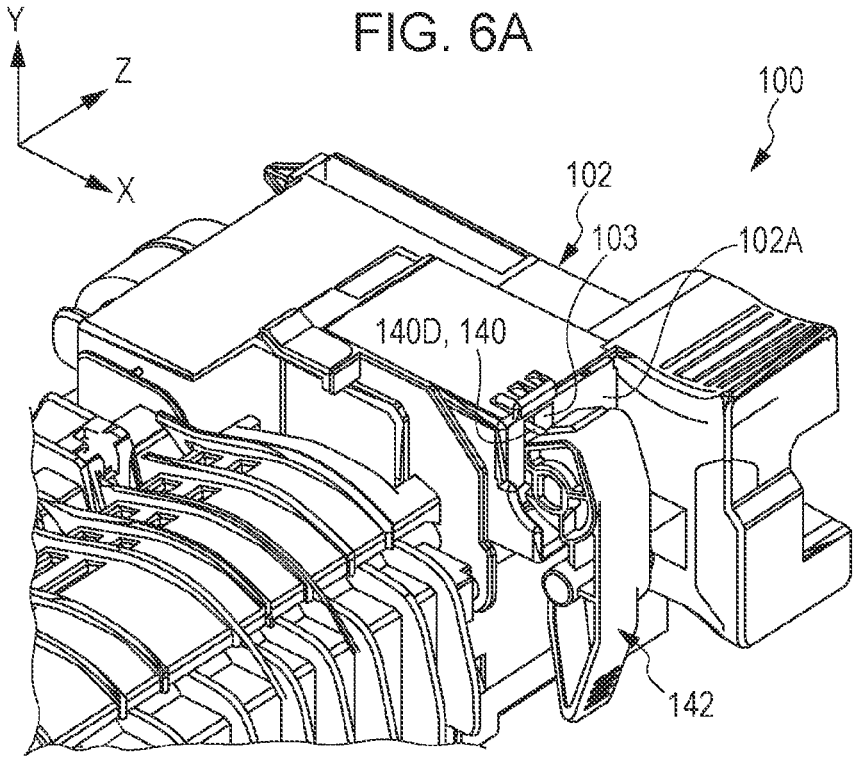
FIGS. 6A and 6B are partial perspective views of a housing in a state in which the operation lever is turned in the exemplary embodiment.

As illustrated in FIG. 6A, the side wall 102A stands upright in the Y-direction at a Z-direction end and on an X-direction side of the housing 102. The side wall 102A has an insertion hole 103 in which the arm portion 140D of the lever member 140 is to be inserted. An end of the arm portion 140D extends out of the housing 102 through the insertion hole 103. Also, the operation lever 142 is attached to be turnable outside the housing 102.

In a state in which the operation lever 142 is hanging in the Y-direction, as illustrated in FIG. 6A, the heating roller 104 and the pressurizing belt 106 are made in contact with each other to form the nip portion N by biasing force of the spring 138 (see FIG. 4A), as illustrated in FIG. 2.

Figure 6B:
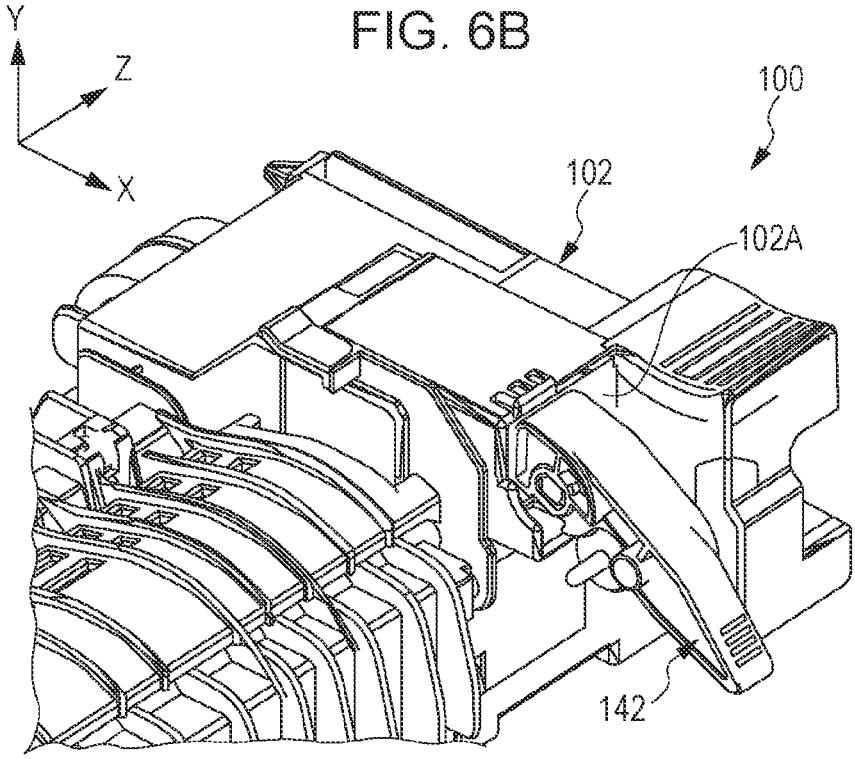

In contrast, in a state in which the operation lever 142 is turned to extend in the X-direction, as illustrated in FIG. 6B, the pressurizing belt 106 withdraws from the heating roller 104 in FIG. 2.

Figure 8:
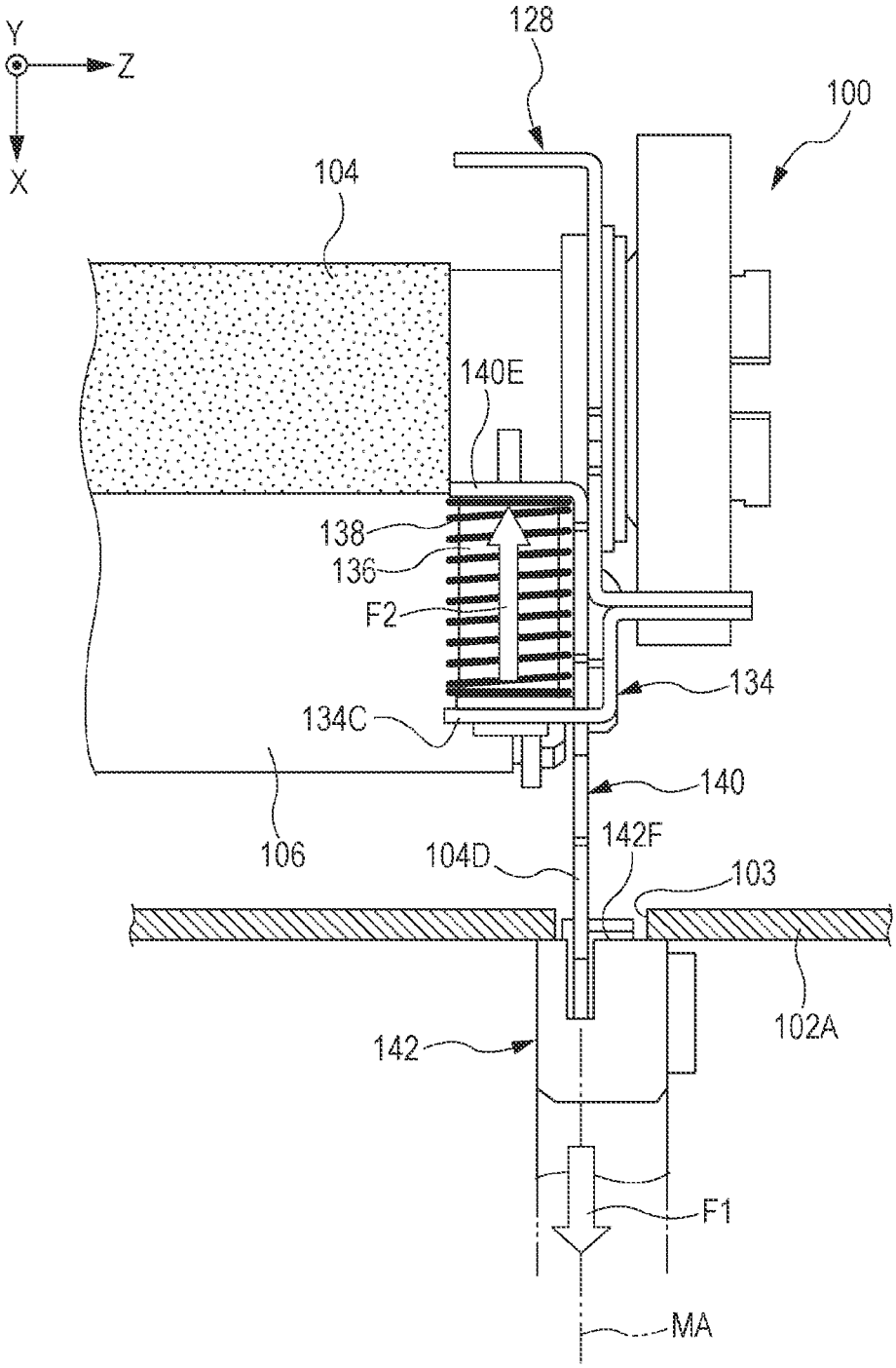
FIG. 8 schematically illustrates a state in which forces act on the operation lever, the lever member, and a bracket in the exemplary embodiment.

As illustrated in FIGS. 7A and 8, a moving path of the lever member 140 (a direction of arrow −R) and a moving path of the operation lever 142 (a direction of arrow R) are in the same plane MA. The plane MA extends along the XY plane.

FIGS. 4A, 4B, 5A, 5B, 6A and 6B illustrate the belt guide member 119 side of the fixing device 100 (see FIG. 3), but do not illustrate a belt guide member 118 side (see FIG. 3). Since the belt guide member 118 side is similar in structure to the belt guide member 119 side, a description thereof is skipped.

Next, a description will be given of a fixing device 200 as a comparative example. Components that are basically similar in structure to those adopted in the fixing device 100 of the exemplary embodiment are denoted by the same reference numerals, and descriptions thereof are skipped.

Figure 9A:
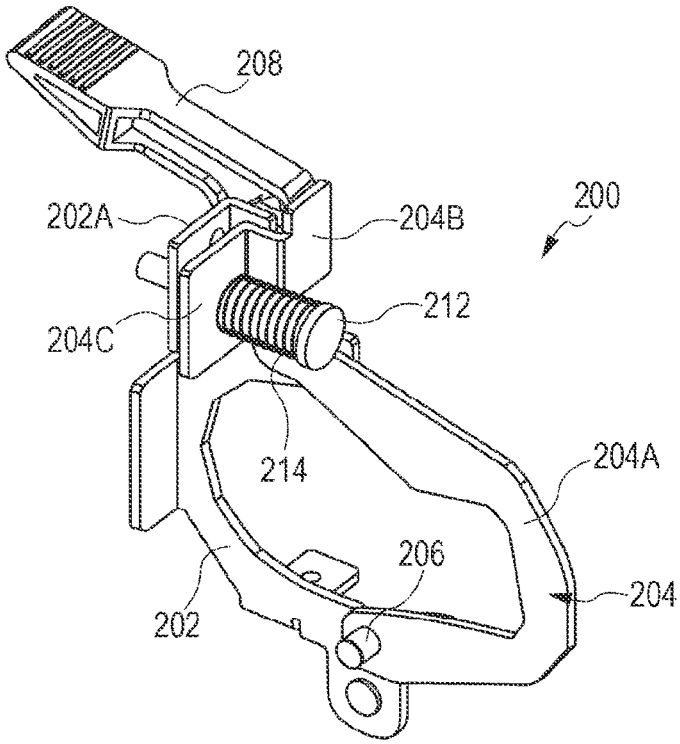
FIG. 9A is a partial perspective view of a fixing device as a comparative example, and FIG. 9B schematically illustrates a state in which forces act on an operation lever, a lever member, and a bracket in the comparative example.
Figure 9B:
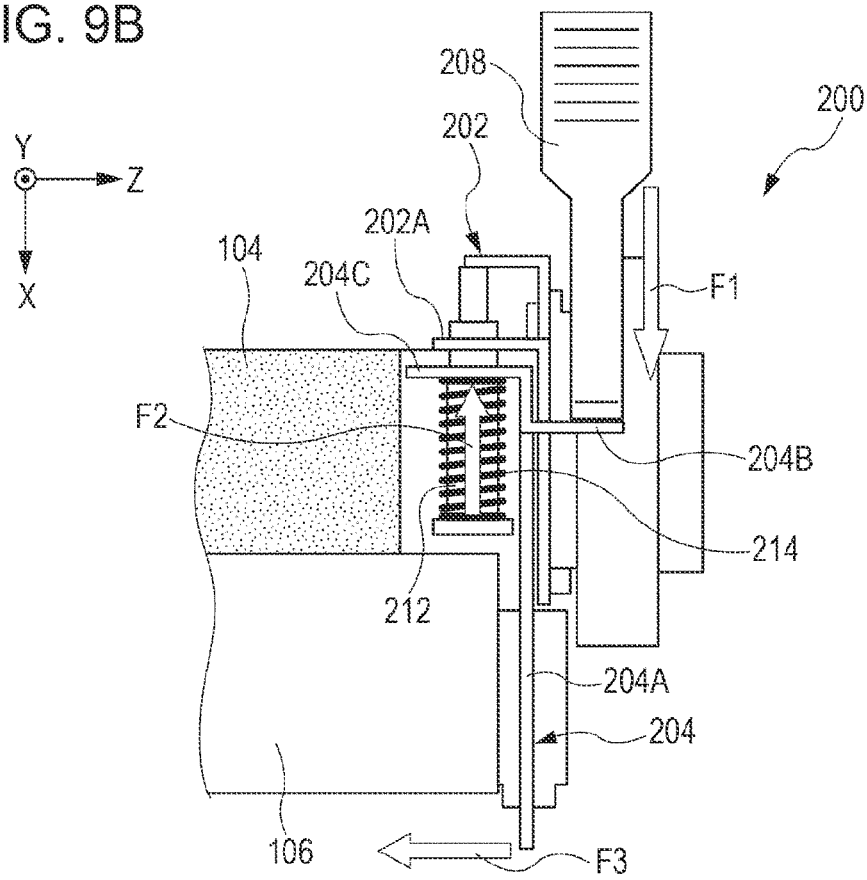

As illustrated in FIGS. 9A and 9B, the fixing device 200 includes a bracket 202, a lever member 204, and an operation lever 208. The bracket 202 is substantially angular U-shaped, as viewed in the Z-direction, and supports an end of a heating roller 104. The lever member 204 is substantially angular U-shaped, as viewed in the Z-direction, and supports an end of a pressurizing belt 106. The operation lever 208 serves to move the lever member 204 in the X-direction. Substantially angular U-shaped portions of the bracket 202 and the lever member 204 oppose each other, and the lever member 204 is turnably connected to a lower end of the bracket 202.

The bracket 202 is fixed to a housing (not illustrated) of the fixing device 200. At the top of the bracket 202, an attachment portion 202A is provided such that a columnar rod 212, whose axial direction is the X-direction, is fixed thereto. Further, the operation lever 208 is turnably attached to the bracket 202 so as to apply an operating force F1 in the X-direction.

In contrast, the lever member 204 includes a support portion 204A, a first biased portion 204B, and a second biased portion 204C. The support portion 204A is substantially angular U-shaped, and supports the end of the pressurizing belt 106. The first biased portion 204B is located on an upper side of the support portion 204A and along the Y-Z plane, and is in contact with the operation lever 208. The second biased portion 204C is located parallel to the Y-Z plane on a side of the support portion 204A opposite the first biased portion 204B in plan view.

A through-hole (not illustrated) penetrates the second biased portion 204C in the X-direction, and the rod 212 is inserted in the through-hole. The rod 212 is also inserted in a spring 214 to hold the spring 214 so that the spring 214 does not fall off. In a normal state, the heating roller 104 and the pressurizing belt 106 are made in contact with each other by a biasing force F2 of the spring 214.

In this fixing device 200 of the comparative example, when the operation lever 208 is turned in a direction such that the first biased portion 204B moves away from the bracket 202, the first biased portion 204B moves in the X-direction and the second biased portion 204C moves in the X-direction against the biasing force F2 of the spring 214 in a direction opposite the X-direction, so that the lever member 204 moves in the X-direction. Then, the pressurizing belt 106 withdraws from an outer peripheral surface of the heating roller 104 (the pressurizing belt 106 comes out of contact with the heating roller 104).

As illustrated in FIG. 9B, when the operation lever 208 is turned in a direction to release pressing of the pressurizing belt 106 in the fixing device 200 of the comparative example, a position where the biasing force F1 acts is shifted from the support portion 204A in the Z-direction. For this reason, a bending stress F3 in a direction opposite the Z-direction acts on the support portion 204, and this sometimes causes bending deformation of the lever member 204 beyond the allowed value.

In a case in which the lever member 204 causes bending deformation, when the heating roller 104 and the pressurizing belt 106 are brought into contact with each other again by turning the lever member 204, the pressure balance between the heating roller 104 and the pressurizing belt 106 is disturbed in the Z-direction. Moreover, the balance of pressure acting on a toner image on a recording sheet P becomes nonuniform. This causes image unevenness and paper wrinkling in the width direction (Z-direction) of the recording sheet P after fixing.

Operation

Next, the operation of the exemplary embodiment will be described.

In a state in which the nip portion N is formed by contact between the heating roller 104 and the pressurizing belt 106, as illustrated in FIG. 7A, when the operating portion 142A of the operation lever 142 is gripped and turned in the direction of arrow R (a direction in the X-Y plane such that the operation lever 142 hanging in the Y-direction is placed in the X-direction), the side face 142E or the inclined face 142F of the operation lever 142 comes into contact with the side wall 102A of the housing 102.

Since the length L2 from the rotation center O of the shaft 144 to the inclined face 142F is longer than the length L1 from the rotation center O to the side face 142E, as the turn angle of the operation lever 142 increases, the rotation center O of the shaft 144 moves away from the side wall 102A of the housing 102 in the X-direction. Then, the lever member 140 turns about the pin member 132 in an arc form in the direction of arrow −R.

Figure 7B:
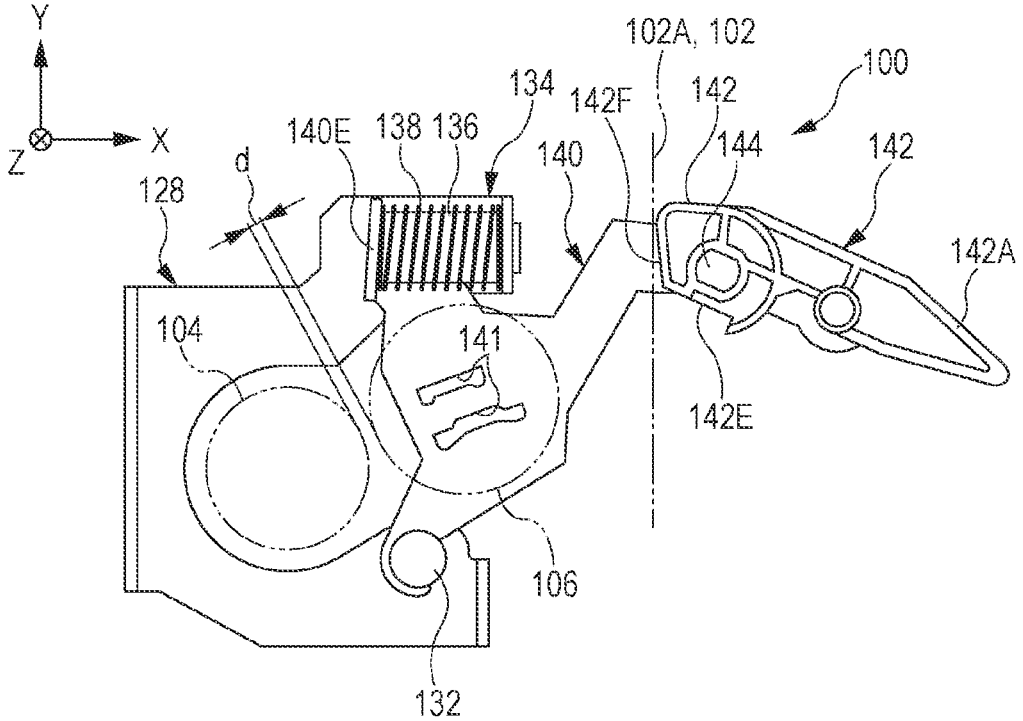

That is, since the operation lever 142 pulls and moves the top of the lever member 140 in the X-direction, as illustrated in FIG. 7B, the pressurizing belt 106 supported by the lever member 140 also moves in the X-direction. Thus, the pressurizing belt 106 withdraws from the outer peripheral surface of the heating roller 104, and pressure from the pressurizing belt 106 is released.

As illustrated in FIG. 8, the operation lever 142 is in contact with the side wall 102A of the housing 102 and the pulling force F1 in the X-direction acts on the lever member 140 in the fixing device 100. Since the lever member 140 holds the operation lever 142 from both sides in the Z-direction (thickness direction), the difference between a load acting on one side of the lever member 140 and a load acting on the other side is reduced, compared with the fixing device 200 of the comparative example (FIGS. 9A and 9B). This may suppress deformation of the lever member 140 in the Z-direction.

Unlike the fixing device 200 of the comparative example (see FIG. 9B), the pressing force F1 does not act on the lever member 140 in the fixing device 100, but the pulling force F1 for pulling the lever member 140 in the in-plane direction (X-direction) acts on the lever member 140. This may suppress bending deformation of the lever member 140 in the Z-direction.

In addition, since the moving path of the lever member 140 and the moving path of the operation lever 142 are in the same plane MA in the fixing device 100, bending deformation of the lever member 140 in the Z-direction may be suppressed, compared with the case in which the operation lever 142 holds the lever member 140 from both sides but the operating portion 142A is shifted in the Z-direction.

Since deformation (bending deformation) of the lever member 140 in the Z-direction is thus suppressed in the fixing device 100, compared with the fixing device 200 of the comparative example, when the heating roller 104 and the pressurizing belt 106 are brought into contact with each other again by turning the lever member 140, the pressure balance between the heating roller 104 and the pressurizing belt 106 in the Z-direction is rarely disturbed. Further, since the pressure balance acting on the toner image on the recording sheet P becomes uniform, image unevenness and paper wrinkling in the width direction (Z-direction) of the recording sheet P after fixing may be suppressed.

The present invention is not limited to the above-described exemplary embodiment.

The operation lever 142 may be symmetrical with respect to the lever member 140 in the Z-direction. Further, the pressurizing belt 106 may be replaced with a pressurizing roller.

The transfer unit may directly transfer a toner image from the photoconductor 22 onto the recording sheet P, instead of using the intermediate transfer belt 32.

Instead of releasing the pressure by moving the pressurizing belt 106 in the direction away from the heating roller 104, the lever member 140 may be provided in the heating roller 104 and the heating roller 104 may be moved in a direction away from the pressurizing belt 106 so as to release the pressure.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating rotating body that heats a developer image formed on a recording medium;

a pressurizing rotating body that pressurizes the recording medium by nipping the recording medium between the pressurizing rotating body and the heating rotating body;

a pair of support plates that rotatably support both ends of one of the pressurizing rotating body and the heating rotating body, the pair of support plates having a thickness direction corresponding to an axial direction of the pressurizing rotating body; and a release member including a contact portion disposed at sides of the pair of support plates to hold the pair of support plates from both sides in the thickness direction, and an operating portion on which an external force acts, wherein, in response to the external force acting on the operating portion, the release member is configured to release pressing of the one of the pressurizing rotating body and the heating rotating body against the other of the pressurizing rotating body and the heating rotating body by moving the pair of support plates in a direction away from the other of the pressurizing rotating body and the heating rotating body.

2. The fixing device according to claim 1, wherein the release member is configured to move the pair of support plates by pulling the pair of support plates in the direction away from the other of the pressurizing rotating body and the heating rotating body.

3. The fixing device according to claim 1, wherein (i) a moving path of the pair of support plates, in response to the release member moving the pair of support plates, and (ii) a moving path of the operating portion, in response to the external force acting on the operating portion, are in the same plane.

4. The fixing device according to claim 2, wherein (i) a moving path of the pair of support plates, in response to the release member moving the pair of support plates, and (ii) a moving path of the operating portion, in response to the external force acting on the operating portion, are in the same plane.

5. An image forming apparatus comprising:

the fixing device according to claim 1;

a developer-image forming unit that forms the developer image; and a transfer unit that transfers the developer image onto the recording medium, wherein the fixing device fixes, on the recording medium, the developer image transferred by the transfer unit by nipping the recording medium between the heating rotating body and the pressurizing rotating body.

6. An image forming apparatus comprising:

the fixing device according to claim 2;

a developer-image forming unit that forms the developer image; and a transfer unit that transfers the developer image onto the recording medium, wherein the fixing device fixes, on the recording medium, the developer image transferred by the transfer unit by nipping the recording medium between the heating rotating body and the pressurizing rotating body.

7. An image forming apparatus comprising:

the fixing device according to claim 3;

a developer-image forming unit that forms the developer image; and a transfer unit that transfers the developer image onto the recording medium, wherein the fixing device fixes, on the recording medium, the developer image transferred by the transfer unit by nipping the recording medium between the heating rotating body and the pressurizing rotating body.

* * * * *